US005781097A

United States Patent [19]

Givler

[11] Patent Number: 5,781,097

[45] Date of Patent: Jul. 14, 1998

[54] DUAL CALIBRATION THERMOSTATIC SWITCH HAVING A WIDE OPERATING RANGE

[75] Inventor: Omar R. Givler, North Canton, Ohio

[73] Assignee: Portage Electric Products, Inc., North Canton, Ohio

[21] Appl. No.: 609,285

[22] Filed: Mar. 1, 1996

[51] Int. Cl.[6] ..... H01H 37/00; H01H 37/54

[52] U.S. Cl. ..... 337/367; 337/333; 337/365; 337/368

[58] Field of Search ..... 337/333, 337, 337/335, 359, 363, 367, 368, 372, 343, 373, 374, 380, 365, 347, 348

[56] References Cited

U.S. PATENT DOCUMENTS

| | | | |
|---|---|---|---|
| 4,389,630 | 6/1983 | Ubukata et al. | 337/363 |
| 4,517,541 | 5/1985 | Ubukata et al. | 337/372 X |
| 4,823,105 | 4/1989 | Givler | 337/368 |
| 5,014,034 | 5/1991 | Wehl | 337/368 |
| 5,268,664 | 12/1993 | Givler | 337/380 |

FOREIGN PATENT DOCUMENTS

WO 87/03137 11/1986 WIPO .

*Primary Examiner*—Leo P. Picard
*Assistant Examiner*—Jayprakash N. Gandhi
*Attorney, Agent, or Firm*—Darby & Darby

[57] ABSTRACT

A thermostatic switch that utilizes a snap acting bimetal blade that deforms at an actuation temperature and returns to an undeformed state at a reset temperature. Actuation and reset projections, preferably in the form of dimples, are provided to calibrate the switch. The bimetal blade has a centrally located, cupped or dish-like snap acting depression. The reset dimple is spaced below the bimetal blade between the snap acting depression and the free end of the bimetal blade instead of substantially directly below the moveable contact as in the prior art. Accordingly, the thermostatic switch may be used in relatively high voltage settings of up to approximately 600 volts without the occurrence of arcing.

8 Claims, 3 Drawing Sheets

DUAL CALIBRATION THERMOSTATIC SWITCH HAVING A WIDE OPERATING RANGE

BACKGROUND OF THE INVENTION

The present invention relates to a thermostatic switch that utilizes a snap acting bimetal blade that deforms at an actuation temperature and returns to an undeformed state at a reset temperature, thereby alternately establishing circuit open and circuit closed conditions of the switch. Even more particularly, the present invention relates to a thermostatic switch that utilizes actuation and reset projections that calibrate the switch to open at a specific temperature and close at a specific temperature. The projections are spaced along the length of the switch to allow a relatively large clearance range between the closed circuit and open circuit states to allow the switch to be used with a wide operating range of applied voltages.

Snap acting thermostatic switches have long been used to protect motors, generators, transformers and like electrical components by breaking contact between the component and a power supply during an elevated transient temperature of the ambient and by re-establishing contact between the component and the power supply when the ambient temperature has cooled to a safe level. Contact is made and broken within the switch by movement of a movable contact, connected to one end of a temperature responsive, snap action, bimetal blade, toward and away from a fixed contact. The blade is mounted in the switch so as to be cantilevered from its other end. There are of course many different switch designs in the prior art. For exemplary purposes, the fixed contact and the bimetal blade can be mounted on a pair of terminal strips that are mounted in a non-conducting case with the strips insulated from one another. As another example, the blade can be mounted on a basewall of an electrically conductive can and the fixed contact can be mounted on an electrically conductive lid that is insulated from the can. As still another example the switch can have an elongated terminal arm and a terminal lug mounted in the open end of a case in an insulated manner from one another. In such a switch the bimetal blade is cantilevered from the terminal lug and the fixed contact is connected to an end of the terminal arm that projects into the case.

The snap action of the bimetal blade is produced by a centrally located, cupped or dish-like portion which can be referred to as a snap acting depression. When the ambient temperature reaches an actuation temperature, a sudden reversal of the shape of the depression occurs to produce a deformed state of the bimetal blade. In the deformed state of the bimetal blade, the movable contact is spaced a distance from the fixed contact and the free end of the blade (on which the movable contact is mounted) is located against some point of contact or step on the switch. Depending upon the switch design, the step can be the terminal strip mounting the bimetal blade, a wall of the case adjacent to the terminal lug that in turn mounts the bimetal blade, or the basewall of the electrically conductive can mounting the bimetal blade. In any of the switch designs, the spacing of the contacts produces a circuit open condition of the switch in which contact between a power supply and an electrical component is broken. After a sufficient time has elapsed, and the ambient has cooled sufficiently to reach a reset temperature, the snap acting depression reverses to return the bimetal blade to an undeformed, dished state to produce a circuit closed condition of the switch. In the circuit closed condition, the movable contact is located against the fixed contact and contact is re-established between the power supply and the electrical component.

The actuation and reset temperatures can be calibrated by providing an adjustable fulcrum-like calibration projection and an adjustable contact point on the switch. These elements are adjusted in height to adjust the position of the free end of the bimetal blade, and hence the movable contact, relative to the fixed contact. An example of such calibration of a thermostatic switch may be found in U.S. Pat. No. 4,823,105 to Givler.

The thermostatic switches of the prior art provide the contact point for affecting the reset temperature at the free end of the bimetal blade, which is substantially directly below the location of the movable contact. This position gives only a small clearance between the movable contact and the fixed contact when the bimetal blade is deformed to break contact and open the circuit. If such a thermostatic switch is used in a high applied voltage condition, arcing may occur across the gap, rendering the actuation stage of the bimetal blade ineffective. Accordingly, thermostatic switches with such configurations are not readily usable with high applied voltage conditions and therefore are not adapted to be used in a wide range of voltages.

SUMMARY OF THE INVENTION

It therefore is an object of the present invention to provide a thermostatic switch that may be used in a wide range of voltage settings, including relatively high voltage settings, such as 600V.

It is a related object of the present invention to provide a thermostatic switch that provides a bimetal blade having a relatively wide range of motion across a clearance gap between a closed circuit position and an open circuit position.

These and other objects of the invention are accomplished in accordance with the principles of the present invention by providing a thermostatic switch having a bimetal blade for moving a movable contact into and out of contact with a fixed contact, to respectively close and open a circuit. A fulcrum-like calibration projection is positioned below the bimetal blade for affecting actuation (snap action of the blade to open the circuit), and a fulcrum-like reset projection is positioned below the bimetal blade for affecting resetting. The reset projection is positioned below and spaced away from the end of the blade to allow the movable contact to move a sufficient distance away from the fixed contact so that the switch may be used in high voltage applications without arcing between the movable contact and the fixed contact.

The above and other objects, features, and advantages of the present invention will be readily apparent from the following detailed description of the invention taken in conjunction with the accompanying drawings wherein like reference characters represent like elements, the scope of the invention being set out in the appended claims.

DETAILED DESCRIPTION OF THE INVENTION

Figure 1:
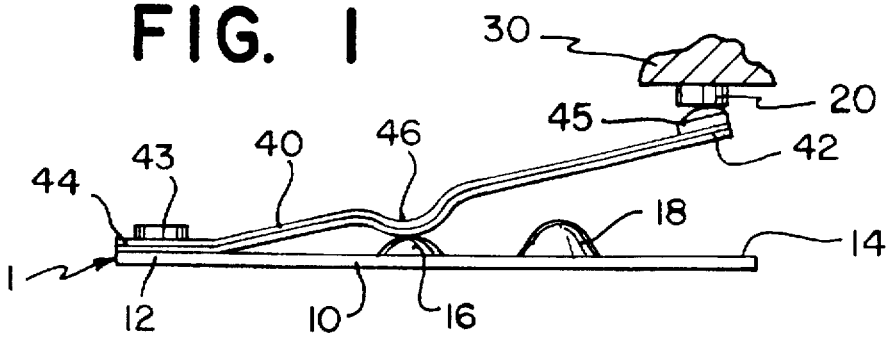
FIG. 1 is a schematic, side elevational view of a thermostatic switch of the present invention in the circuit closed condition.

FIG. 1 is a schematic illustration of a thermostatic switch 1. Switch 1 can have an elongated, electrically conductive terminal strip 10 or other such conductive base surface (such as the cup of a can-type switch such as shown in U.S. Pat. No. 4,268,664 to Givler), a fixed contact 20, a bimetal blade 40 and a movable contact 45 mounted on free end 42 of blade 40. A portion of the switch, illustrated by 30, is provided for mounting the fixed contact 20 so as to be spaced from and to face towards the terminal strip 10. The bimetal blade 40 can be connected at the fixed end 44 to end 12 of the terminal strip 10 in a cantilevered manner by means of a weld button 43. As illustrated, free end 42 of the bimetal blade freely extends along a side of the terminal strip 10 facing towards the fixed contact 20. The movable contact 45 faces towards the fixed contact 20. The bimetal blade also has a well known dish-like or cupped portion to form a snap acting depression 46 located between the ends 42 and 44. It is important to point out here that the depression 46 is preferably between about 0.100 mm. and about 0.152 mm. deep for a switch formed in accordance with the present invention to properly function with a snap action.

The position of movable contact 45 with respect to fixed contact 20 is controlled by the condition (whether undeformed or deformed) of snap acting depression 46 on bimetal blade 40. FIG. 1 illustrates the bimetal blade 40 in its initial, undeformed state in which the movable contact 45 is located against the fixed contact 20 to form a circuit closed condition of the switch 1. Snap acting depression 46 is in an undeformed state because switch 1 is at an operating temperature. A well known fulcrum-like actuation projection 16 can be formed in the terminal strip 10 and bears against the snap acting depression 46 of the bimetal blade 40. The function of projection 16 will be discussed in greater detail below.

Figure 2:
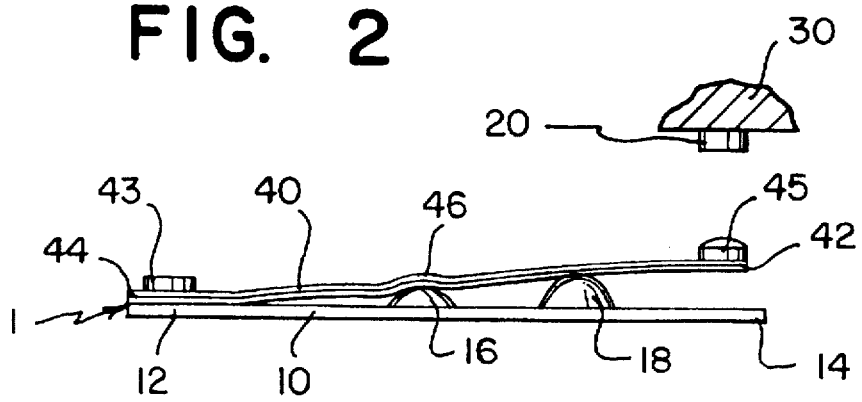
FIG. 2 is a schematic, side elevational view of a thermostatic switch of the present invention in the circuit open condition.

With reference now also to FIG. 2, a circuit open condition of the thermostatic switch is illustrated in which the actuation temperature has been reached, causing the snap acting depression 46 to snap towards the fixed contact 20 to produce a deformed state of the bimetal blade 40. Movable contact 45 is thus moved away from the fixed contact 20 and the free end 42 of the blade 40 approaches end 14 of the terminal strip 10. A portion of blade 40 between free end 42 and depression 46 is located against fulcrum-like reset projection 18, formed in terminal strip 10. Projection 18 functions in a manner well know in the art to prevent welding of the blade 40 to terminal strip 10 by electrical arcing between the contacts. Thus, free end 42 of blade 40 is prevented from contacting end 14 of the terminal strip 10. The function of projection 18, as well as its inventive structure and location, will be discussed in greater detail below.

Figure 3:
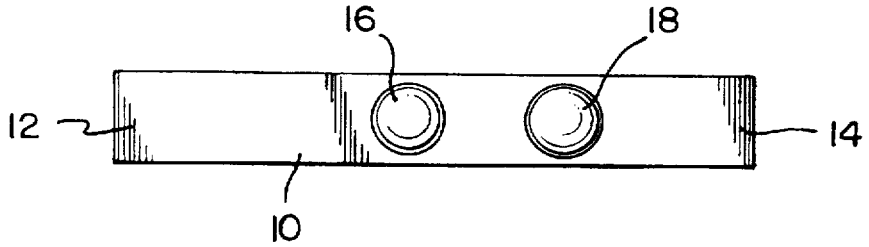
FIG. 3 is a plan view of the elongated strip shown in FIGS. 1 and 2.
Figure 4:
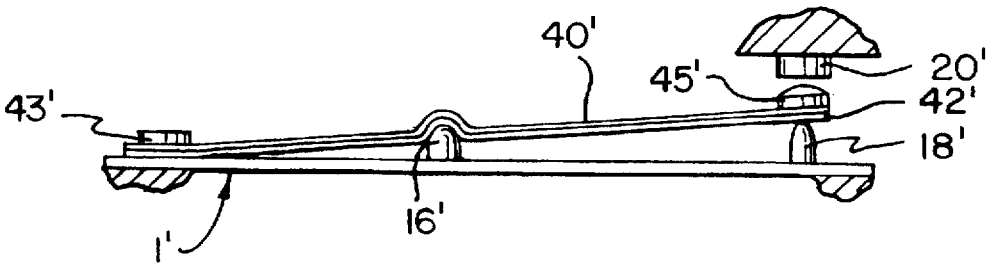
FIG. 4 PRIOR ART
FIG. 4 is a schematic, side elevational view of a thermostatic switch of the prior art.

The pressure of fulcrum-like reset projection 18 against blade 40 when in the deformed, circuit open condition of FIG. 2 determines the reset temperature of switch 1 at which the snap acting depression 46 returns to its undeformed state to move movable contact 45 into contact with fixed contact 20. Projection 18 also functions to separate blade 40 from terminal strip 10. In the thermostatic switches of the prior art, such as shown in FIG. 4, the location of the reset projection 18' substantially below the free end 42' of the bimetal blade 40' and the movable contact 45' provides a contact separation of as little as 0.0025 mm. Such a separation does not provide enough clearance or dielectric strength for use of the switch in a 240–600 volt setting. In accordance with the present invention, fulcrum-like reset projection 18 is not provided at end 14 of terminal strip 10 as in the prior art (FIG. 4). Instead, as may be seen in the plan view of FIG. 3, projection 18 is spaced apart from end 14 and is closer to projection 16 than in the prior thermostatic switches and contacts a portion of blade 40 between free end 42 (on which movable contact 45 is mounted) and depression 46, as may be seen in FIG. 2. Preferably, projection 18 is spaced/located from the edge of depression 46 approximately one-half the distance from the edge of depression 46 to the inside edge of movable contact 45. This location of projection 18 reduces the interference of the heightened area created by projection 18 with the approach of free end 42 of blade 40 to terminal strip 10. Thus, movable contact 45 of switch 1 of the present invention is allowed more travel room away from fixed contact 20 than movable contact 45' of the prior art (FIG. 4) is allowed from fixed contact 20'. Consequently, moveable contact 45 is allowed more contact separation just prior to reset than movable contact 45' is allowed from fixed contact 20' when reset projection 18' is positioned substantially directly below free end 42' of blade 40' as in prior art switch 1' of FIG. 4. Nonetheless, projection 18 interferes sufficiently with the position of free end 42 relative to terminal strip 10 to prevent possible welding of blade 40 to terminal strip 10. Because projection 18 allows for greater clearance between movable contact 45 and fixed contact 20 than prior art switches, switch 1 of the present invention can be used in 240–600 volt settings without arcing or other undesirable effects.

Preferably projections 16 and 18 are formed as dimples in terminal strip 10, and the depth and width of the dimples may be varied as desired to effect the actuation and reset temperatures, respectively. Thus, the dimensions of projections 16 and 18 are typically a function of the calibration temperature and the reset temperature. Alternatively, at least projection 18 may be formed as a limit stop projection, such as disclosed in above-mentioned U.S. Pat. No. 4,823,105. The dimensions given herein are thus exemplary and non-limiting. By adjusting the height of dimple 18 as measured from the bottom of terminal strip 10, such as in a suitable calibration fixture, the reset temperature of the switch can be accurately set.

A method of calibrating switch 1 is illustrated in FIGS. 5–10. The following method utilizes a calibration machine such as is known in the art. However, the calibration screws are spaced differently than those of the prior art in order to create calibration dimples spaced in accordance with the principles of the present invention, as described above.

Figure 5:
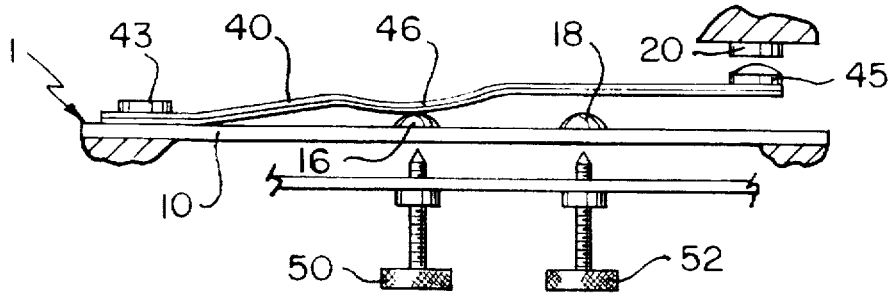
FIG. 5 is a schematic, side elevational view of a thermostatic switch placed in a calibration machine with the temperature raised to the desired snap-off temperature.
Figure 6:
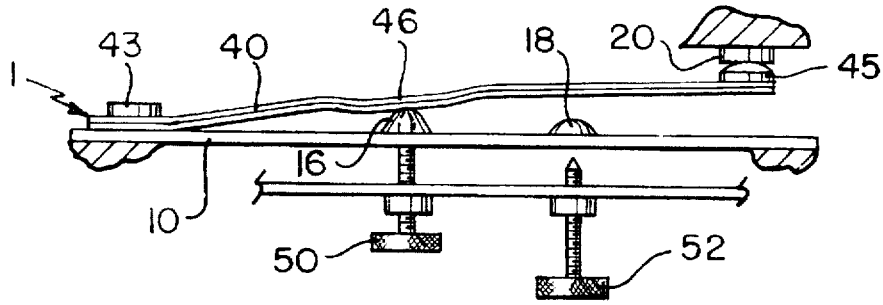
FIG. 6 is a schematic, side elevational view of a thermostatic switch, showing a calibration screw setting the actuation projection.
Figure 7:
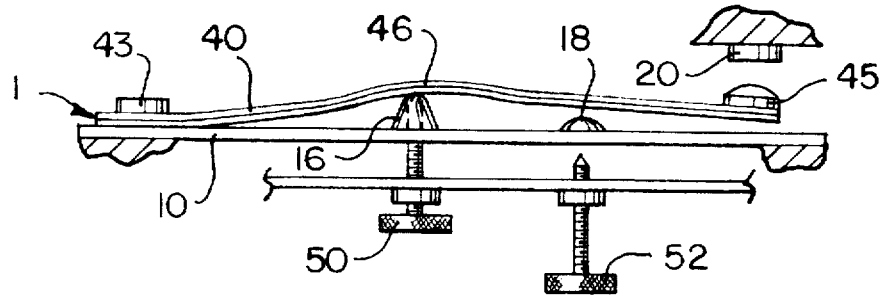
FIG. 7 is a schematic, side elevational view of a thermostatic switch as in FIG. 6, with the calibration screw screwed in further.
Figure 8:
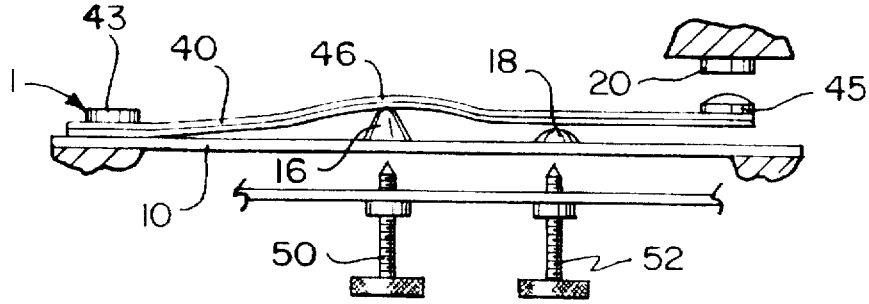
FIG. 8 is a schematic, side elevational view of a thermostatic switch with the calibration screw screwed away from the actuation projection, and the temperature being reduced to the desired reset temperature.

As shown in FIG. 5, switch 1 is placed in a calibration machine, and the temperature within the machine is raised to the desired snap-off actuation temperature. This causes depression 46 in blade 40 to begin to deform and thereby cause moveable contact 45 to move away from fixed contact 20. The deformation of depression 46 is hastened by the presence of the actuation projection 16. Calibration screw 50, which is shown in a rest position in FIG. 5, is screwed in towards actuation projection 16 to further extrude actuation projection 16 to cause pressure in depression 46 of bimetal blade 40. Calibration screw 50 has been inserted sufficiently when depression 46 snaps into a deformed state such as shown in FIG. 7. Moveable contact 45 is thereby moved away from fixed contact 20. Calibration screw 50 may then be screwed away from actuation projection 16, as shown in FIG. 8, leaving actuation projection 16 at the desired calibration height or depth. Typical dimensions of actuation projection 16 are approximately 0.508 mm.±0.025 mm. in depth and approximately 0.813 mm.±0.025 mm. in width (diameter).

Figure 9:
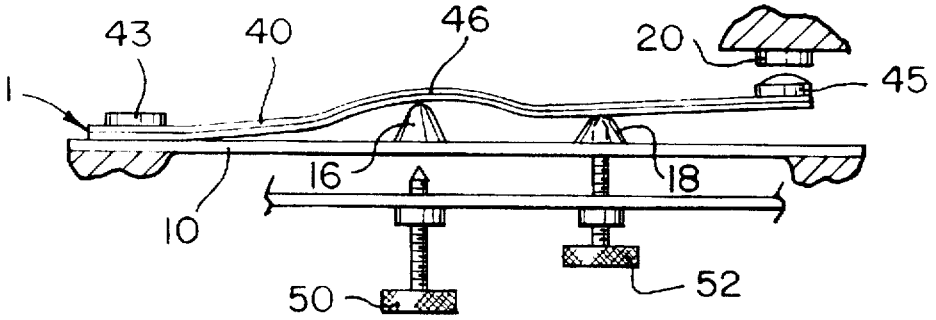
FIG. 9 is a schematic, side elevational view of a thermostatic switch as in FIG. 8, with the reset calibration screw being screwed in toward the reset projection.
Figure 10:
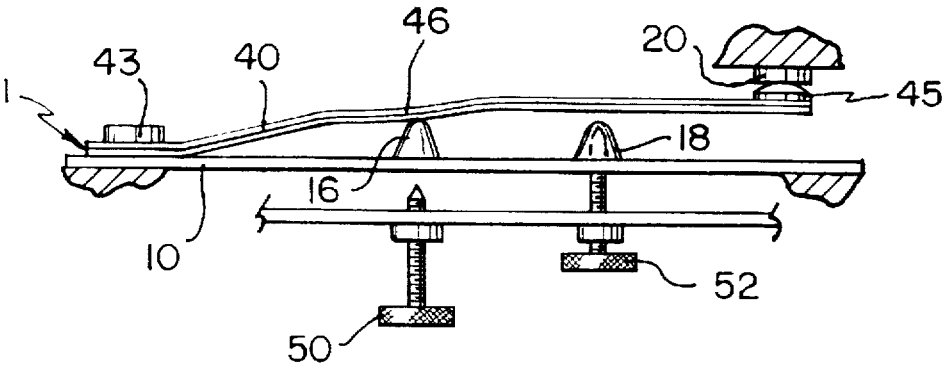
FIG. 10 is a schematic, side elevational view of a thermostatic switch as in FIG. 9, but with the reset calibration screw causing the reset calibration projection to cause the switch to reset.

Once actuation projection 16 has been set, the temperature within the machine is then lowered to the desired reset temperature so that reset projection 18 may be set. As shown in FIG. 9, reset calibration screw 52 is screwed in towards reset projection 18 to cause reset projection 18 to extrude against the rigid part of bimetal blade 40 between depression 46 and moveable contact 45. Reset projection 18 is thus pressed against blade 40 to cause free end 42, along with moveable contact 45, to move towards fixed contact 20. Additional screwing in of reset calibration screw 52, such as shown in FIG. 10, causes additional extrusion of reset projection 18 and consequent inversion of deformed depression 46 back into its undeformed state. Typical dimensions of reset projection 18 are approximately 0.787 mm.±0.025 mm. in depth and approximately 0.813 mm.±0.025 mm. in width (diameter). Moveable contact 45 is thus brought back into contact with fixed contact 20. Switch 1 may now be removed from the calibration machine and used as desired.

While the foregoing description and drawings represent the preferred embodiments of the present invention, it will be understood that various additions, modifications and substitutions may be made without departing from the spirit and scope of the present invention as defined in the accompanying claims.

What is claimed in the invention is:

1. A thermostatic switch having means to calibrate both actuation temperature and reset temperature, comprising:

a fixed contact;

a bimetal blade having a fixed end, a free end, and a snap acting depression located between said fixed end and said free end, said snap acting depression being in an undeformed, dished configuration when said switch is at an operating temperature and in a deformed configuration when said switch is at an actuation temperature above said operating temperature;

a movable contact connected to said free end of said bimetal blade;

a base surface spaced apart from said fixed contact and having first and second ends, said fixed contact facing said first end of said base surface, said fixed end of said blade being mounted in a cantilevered manner on said second end of said base surface so that when said snap acting depression of said blade is in its initial, undeformed state, said movable contact is located against said fixed contact, and when said snap acting depression of said blade is in its deformed state, said movable contact is spaced from said fixed contact and approaches, without contacting, said first end of said base surface;

an actuation projection in said base surface positioned to bear against said snap acting depression to cause said depression to snap to said deformed state upon reaching an actuation temperature; and a reset projection in said base surface positioned between said first end of said base surface and said actuation projection, said reset projection being positioned to bear against a portion of said blade between said free end of said blade and said snap acting depression to cause said snap acting depression to return to said undeformed state upon reaching a reset temperature.

2. A thermostatic switch as in claim 1, wherein said actuation projection is a dimple in said base surface.

3. A thermostatic switch as in claim 2, wherein the depth of said actuation projection dimple is determined as a function of the desired actuation temperature.

4. A thermostatic switch as in claim 1, wherein said reset projection is a dimple in said base surface.

5. A thermostatic switch as in claim 4, wherein the depth of said reset projection dimple is determined as a function of the desired reset temperature.

6. A thermostatic switch as in claim 1, wherein said reset projection is spaced from said first end of said base surface a predetermined distance that provides sufficient clearance between said movable contact and said fixed contact when said depression is in its deformed state to allow for said thermostatic switch to be used in a setting of up to approximately 600 volts without the occurrence of arcing between said fixed contact and said movable contact.

7. A thermostatic switch as in claim 6, wherein:

said snap acting depression has an edge facing said free end of said blade;

said movable contact has a center; and said reset projection is spaced from said first end of said base surface to be positioned from said edge of said snap acting depression approximately one-half the distance from said edge of said snap acting depression to said inside edge of said movable contact.

8. A thermostatic switch as in claim 1, wherein said base surface comprises an elongated member.

* * * * *